United States Patent [19]

Hawkins

[11] 4,190,271

[45] Feb. 26, 1980

[54] SLIDING WINDOW CHANNEL LOCK

[76] Inventor: Donald Hawkins, P.O. Box 1203, Tracy, Calif. 95376

[21] Appl. No.: 957,738

[22] Filed: Nov. 6, 1978

[51] Int. Cl.[2] ..... E05C 19/06

[52] U.S. Cl. ..... 292/145; 292/DIG. 46

[58] Field of Search ..... 292/145, 258, 288, DIG. 46, 292/DIG. 47

[56] References Cited

U.S. PATENT DOCUMENTS

| | | | |
|---|---|---|---|
| 262,038 | 8/1882 | Hayhurst | 292/288 |
| 579,631 | 3/1897 | Zuppann | 292/DIG. 47 |
| 938,641 | 11/1909 | Cornelison | 292/DIG. 47 |
| 2,018,281 | 10/1935 | Roberts | 292/DIG. 47 |
| 2,988,787 | 6/1961 | Migneault et al. | 292/DIG. 46 |
| 3,015,134 | 1/1962 | Migneault et al. | 292/DIG. 47 |
| 3,378,293 | 4/1968 | Silk | 292/DIG. 47 |
| 3,640,559 | 2/1972 | Royer | 292/DIG. 46 |

FOREIGN PATENT DOCUMENTS

| | | | |
|---|---|---|---|
| 448495 | 7/1945 | Canada | 292/288 |

*Primary Examiner*—Richard E. Moore

[57] ABSTRACT

A lock for use in conjunction with a window panel slidably supported in a track of a channel member includes a stop member which is permanently and translatably secured in the track of the channel member. The stop member impinges on selected ones of the weep hole openings in the channel member to limit the sliding translation of the window panel in its track. In one embodiment the stop member includes a longitudinally extending, inverted U-shaped portion, with flanges extending laterally in opposite directions from the distal edges of the U-portion. In another embodiment, the stop member includes horizontal and vertical web portions joined edge to edge, with an oblique web portion extending from the upper edge of the vertical web portion above the horizontal web portion. A pair of tab members may extend from the oblique portion to facilitate manual positioning of the stop member in the track.

10 Claims, 9 Drawing Figures

FIG_1
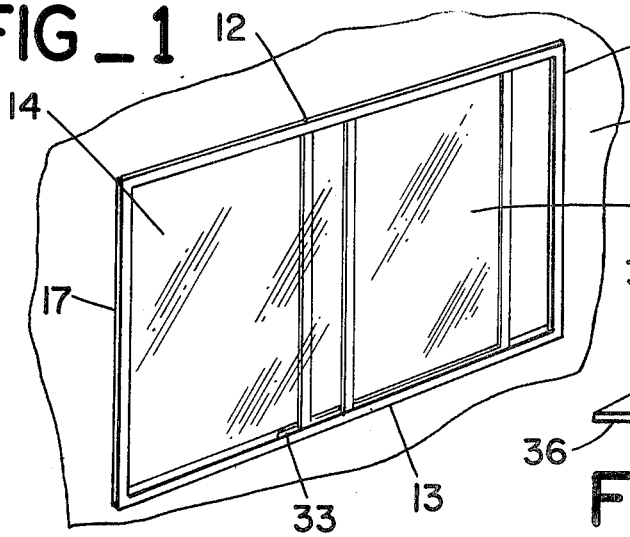
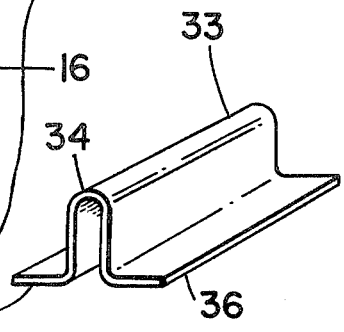
FIG_2
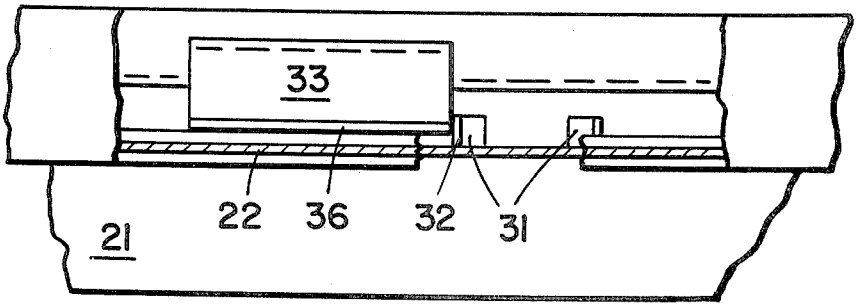
FIG_3
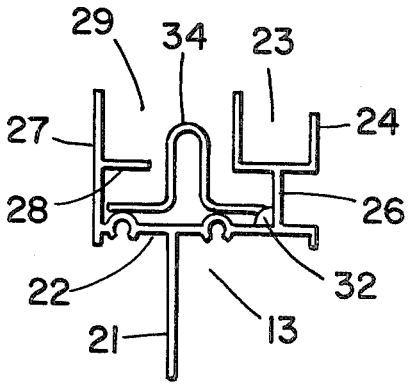
FIG_4
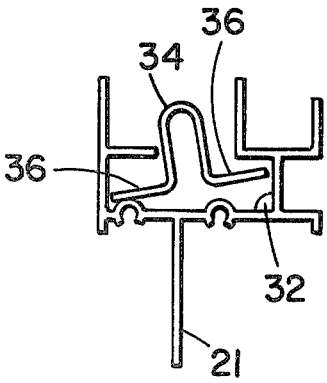
FIG_5

SLIDING WINDOW CHANNEL LOCK

BACKGROUND OF THE INVENTION

In the field of construction of dwellings, commercial buildings, and similar structures, there has been great increase in recent years in the use of windows and vents which employ sliding panels. These windows and vents usually comprise a pair of parallel, horizontal channel members having a pair of adjacent tracks therein which receive the window or vent panel and permit them to be slidably and horizontally translated. Often, these units are pre-assembled by original equipment manufacturers using end rails or channel members to join the horizontal channel members together with the panels assembled therein. The pre-fabricated units are then installed in wall openings which are dimensioned to receive the units.

Although sliding panel vent and window units cannot be blown open by the wind, they are quite susceptible to being opened in an unconventional manner by vandals and thieves. To remedy this situation, there have been devised in the prior art many forms of locks to seal the units and prevent unauthorized entry thereby. Other lock devices limit the opening afforded by the vent or window to prevent entry therein. In general, these lock devices are an added expense for each window, an expense which is greatly multiplied in a structure having many windows. Also, many of the lock units which require the proper keys for opening are a safety hazard in an emergency, in that they do not permit egress without the use of the proper key. During fires or similar emergencies, the time wasted unlocking a key locked sliding window may determine the difference between escape and injury or death.

Also known in the prior arts are devices which obstruct the track of the channel members to limit the opening of the sliding panel. These devices often screw or bolt to the channel member of the unit, and are thus poorly adapted to provide variable opening of the unit. These devices also add to the cost of each window or vent unit.

SUMMARY OF THE PRESENT INVENTION

The present invention generally comprises a lock device for a sliding panel window or vent unit which provides a great degree of freedom in selecting the amount of opening provided by the sliding panel unit. Further, the device of the present invention is simple, permanently installed in a pre-assembled unit, and very inexpensive. It is also easily manipulated to permit full opening of the sliding panel in an emergency situation.

The device for the present invention is particularly adapted for use in conjunction with sliding panel vent and window units which employ upper and lower channel members having tracks in which the panel slidably translate. Generally speaking, the channel members include weep holes extending from the inner track therein to the outer surface thereof so that any precipitation or moisture will drain from the inner track. The weep holes are formed by punching out a small portion of the track, providing a small protusion into the track area which does not interfere with the sliding movement of the panels.

The device of the present invention includes a stop member which is secured in the inner track of the channel of the vent or window unit, and which is particularly adapted to engage the protusion formed by the weep hole. The protusion prevents translation of the stop member, and the stop member in turn prevents translation of the panel member which rides in the track. The stop member maybe lifted to disengage any weep hole protusion, although its configuration prevents removal of the stop member from the track. Due to the fact that most track constructions include a plurality of weep holes spaced therealong, the present invention provides great freedom in selecting the degree of opening of the vent or window unit.

In one embodiment of the present invention the stop member includes a short length of inverted, U-shaped channel member, with flanges extending outwardly in laterally opposed fashion from the edges of the U-portion. The flanges are adapted to engage the protusions of the weep hole, and are sufficiently wide to prevent removel of the stop member from the track which receives the sliding panel.

In another embodiment the stop member comprises a horizontal web portion slightly narrower than the track width, with a vertical web portion extending upwardly from one edge of the horizontal web portion. An oblique web portion extends upwardly from the upper edge of the vertical web portion, above the horizontal web portion. The corner formed by the junction of the horizontal and vertical web portions is adapted to engage the protusions of the weep holes, while the width of the horizontal web portion and the extent of the oblique web portion prevent removal of the stop member from the track. A pair of tabs may be provided at the opposed ends of the oblique web portion to facilitate manipulation of the stop member and its placement adjacent to any one of the protusions of the weep holes.

A BRIEF DESCRIPTION OF THE DRAWING

FIG. 1 is a perspective view of a sliding panel vent or window for which the present invention is adapted for use.

FIG. 2 is a perspective view of one embodiment of the stop member of the present invention.

FIG. 3 is a partially cut away side elevation of the embodiment of FIG. 2, shown in use with a sliding panel unit.

FIG. 4 is an end view of the embodiment of FIG. 2, shown engaged in a track of a sliding panel unit.

FIG. 5 is an end view of the embodiment of FIG. 2, shown disengaged in a track of a sliding panel unit.

DESCRIPTION OF THE PREFERRED EMBODIMENT

Figure 6:
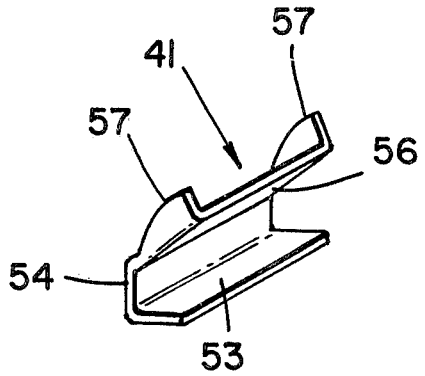
FIG. 6 is a perspective view of a further embodiment of the present invention.
Figure 7:
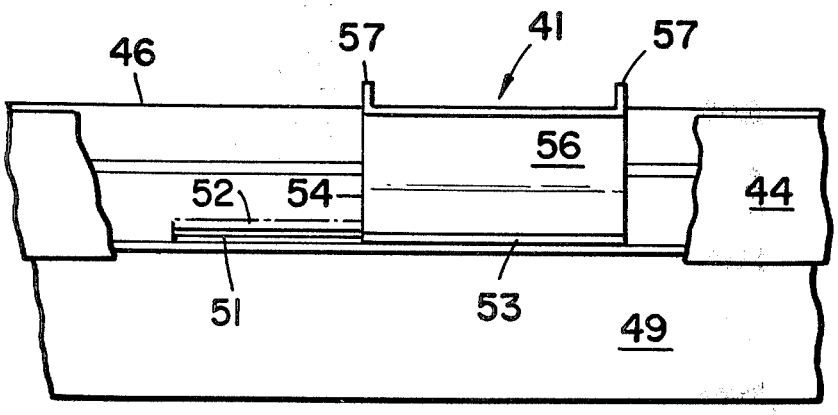
FIG. 7 is a partially cut away side elevation of the embodiment of FIG. 6, shown disposed in the track of a sliding panel.

The present invention generally comprises a lock device for use in conjunction with vent or window units which employ sliding panels for opening or closing. As shown in FIG. 1, a typical vent or window unit 11 includes upper and lower channel members 12 and 13 which has adjacent tracks therein to receive a pair of panel units 14 and 16 in sliding, translatable fashion. A pair of end members 17 and 18 join the like ends of the spaced apart channel members 12 and 13 to form the preassembled unit 11 in which the panel members 14 and 16 are permanently secured.

Each of the channel members 12 and 13 include a subjacently dependent, longitudinally extending vertical panel member 21, as shown in FIG. 4 and 5. A longitudinally extending horizontal panel member 22 is joined to the panel 21 in offset T fashion. The channel members each include an outer track 23 which is formed by an upwardly opening, longitudinally extending C-shaped member 24 which is in turn supported by a longitudinally extending web 26 projecting upwardly from the horizontal panel 22. An inner panel 27 extends upwardly from the inner edge of the horizontal panel 22, and includes a horizontal web member 28 projecting laterally from the mid-point of the member 27. An inner channel 29 is defined by the longitudinally extending gap between the member 27 and the member 24 and 26. A plurality of weep hole openings 31 are spaced along the channel members 12 and 13, as shown in FIG. 3. The openings 31 are formed by punching out small portions 32 of the web 26, the portions 32 projecting into the area of the inner track 29, as shown in FIGS. 4 and 5.

Generally speaking, the outer track 23 receives the outer panel 14 in slidably translating fashion. The inner track 29 receives the inner panel 16, also in slidably translating fashion.

The present invention generally comprises a stop member 33 which is adapted to be permanently secured in the inner track 29. Further, the stop member 33 is adapted to engage any one of the numerous weep hole punch-out members 32 which project into the track area 29. The engagement of the member 33 with the punch-out tab 32 prevents any slidable translation of the member 33. The member 33 in turn limits the slideable translation of the inner panel 16 of the unit 11.

The member 33 includes an inverted U-shaped portion 34, with flanges 36 extending laterally in opposed fashion from the lower edge portions of the U-shaped portion 34. The lateral extent of the flanges 36 is slightly less than the spacing between the web members 26 and 27. Due to the presence of the horizontal web 28 and the horizontal portion of the C-shaped member 24, the flange members 36 prevent the stop member 33 from being removed from the track 29.

It should be noted that one of the flange members 36 may selectively engage one of the punch-out tabs 32 of the channel member 13, as shown in FIG. 4. In this disposition the stop member will limit the sliding translation of the panel 16, in accordance with its placement along the longitudinal extent of the channel member 13. The stop member 33 cannot be reached by a would-be intruder or burglar, since it is disposed interiorly of the exterior panel 14, as shown in FIG. 1.

It maybe appreciated that the stop member 33 maybe lifted slightly so that the flange 36 clears the weep hole tab 32, as shown in FIG. 5. This can only be done by an individual positioned on the interior side of the unit 11. Although the stop member 33 cannot be removed, it can be slideably translated to any position along the track 29 when in the lifted disposition shown in FIG. 5. Thus, the stop member easily may be positioned to provide the desired maximum opening of the inner panels 16. Likewise, the member 33 may be quickly lifted and positioned at the extreme end of the track 29 to provide maximum opening of the panel 16 for emergency egress. With the member 33 disposed in the medial portion of the track 29, the panel 16 may be effectively locked shut.

Figure 8:
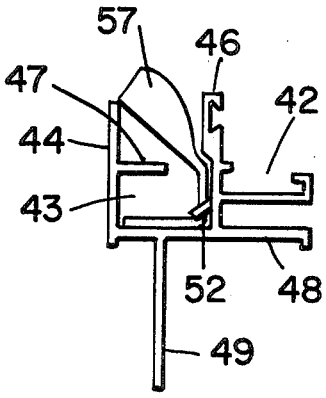
FIG. 8 is an end view of the embodiment of FIG. 6, shown engaged in a track of a sliding panel.
Figure 9:
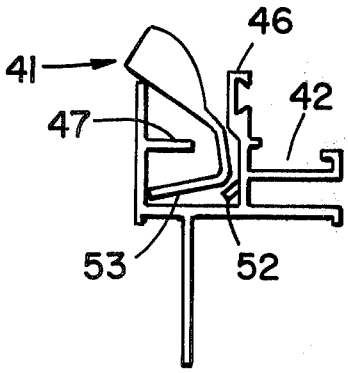
FIG. 9 is an end view of the embodiment of FIG. 6, shown disengaged in a track of a sliding panel.

Another embodiment of the present invention comprises a stop member 41 which is adapted for use in another common form of the channel members 12 and 13. As shown in FIGS. 8 and 9, this channel includes an outer track 42 and an inner track 43. A pair of vertically disposed longitudinally extending web members 44 and 46 define the inner track 43. A horizontally disposed, longtidunally extending web 47 extends from the mid-line of the web 44 into the area of the track 43. The web members 44 and 46 extend upwardly from a horizontal panel 48, and a vertical panel 49 depends subjacently from the panel 48. A weep hole 51, which is provided to drain moisture from the track 43 to the exterior of the unit is formed by a tab 52 which is die-cut from the lower extremity of the web 46 and bent upwardly into the area of the track 43. The stop member 41 of the alternative embodiment is adapted to engage any of the tab members 52 in the same manner as the foregoing embodiment.

The stop member 41 includes a horizontal panel 53 and a vertical panel 54 extending orthogonally from one longitudinal edge of the panel 53. An oblique panel 56 extends upwardly from the upper edge of the panel 54, and is disposed generally superadjacent to to panel 53. The lateral extent of the panel 53 is slightly less than the spacing of the web members 44 and 46. As shown in FIG. 9, the lateral extent of the panel 53, together with the height of the panel 54 and 56 prevent the stop member 41 from being removed from the track 43. As in the previous embodiment, the stop member 41 may be disposed directly adjacent to any tab 52, so that the stop member 41 impinges thereon, as shown in FIG. 8, and is thereby prevented from any slideable translation. In this disposition, the stop member will also prevent the sliding panel 16 from being slideably translated. Of course, the stop member 41 may be manually lifted to disengage the tab 52, so that it may be placed at any position along the longitudinal extent of the track 43. A pair of tabular members 57 may be provided, extending from the opposed ends of the oblique panel 56 to facilitate manual manipulation of the member 41. Thus the stop member 41 may also be used to lock the panel 16 in the fully closed position, and it is also capable of quick repositioning to permit full opening of the panel 16 in emergency situations.

Both embodiments of the present invention, the stop members 33 and 41, are permanently installed in their respective tracks, and thus cannot be removed or stolen by vandals or thieves. Also, neither of the stop members of the present invention extends laterally beyond their respective channel members. This characteristic permits a plurality of units 11 to be stacked directly adjacent each to the other, with the like channel members of the plurality of units in direct impingement. This characteristic facilitates easy handling and shipment of the units 11.

I claim:

1. In a channel-like track construction for receiving a sliding member and including a plurality of protrusions extending into the track channel, a locking device shaped to permit movement past said protrusions and abut a selected protrusion and for preventing translation of said sliding member, including means for releasably engaging any one of said protrusions in immobilizing fashion, and means for permanently securing said locking device in said track channel.

2. The locking device of claim 1, wherein the shape thereof includes an inverted U-portion extending longitudinally in said track channel, and a pair of laterally disposed flange portions extending in opposed fashion from the distal edges of said inverted U-portion.

3. The locking device of claim 2, wherein the lateral extent of said flange portions is substantially the same as the width of said track channel.

4. The locking device of claim 2, wherein said flange portions engage one of said protrusions in said track.

5. The locking device of claim 1, wherein the shape thereof includes a lateral web portion, an upstanding web portion joined at one edge to an edge of said lateral web portion, and an oblique web portion joined to the other edge of said upstanding web portion.

6. The locking device of claim 5, wherein the lateral extent of said lateral web portion is substantially the same as the width of said track channel.

7. The locking device of claim 5, wherein all of said web portions extend longitudinally in said track channel.

8. The locking device of claim 5, wherein said oblique web portion is disposed directly above and spaced apart from said lateral web portion.

9. The locking device of claim 5, further including a pair of tab members extending from opposed ends of said oblique web portion.

10. The locking device of claim 5, wherein the vertex formed by the junction of said lateral and upstanding web portions engages one of said protrusions in said track channel.

* * * * *